United States Patent [19]

Bory et al.

[11] 4,260,054

[45] Apr. 7, 1981

[54] LAUNDRY ADDITIVE POUCH

[75] Inventors: Barbara H. Bory, Fort Lee; Alan B. Kessler, Ramsey, both of N.J.

[73] Assignee: Lever Brothers Company, New York, N.Y.

[21] Appl. No.: 120,024

[22] Filed: Feb. 11, 1980

[51] Int. Cl.[3] ..... D06F 39/02

[52] U.S. Cl. ..... 206/0.5; 68/17 A

[58] Field of Search ..... 68/17 A; 206/0.5; 239/53-56; 222/87, 105; 426/77, 82, 83, 123; 34/60

[56] References Cited

U.S. PATENT DOCUMENTS

| | | | |
|---|---|---|---|
| 2,196,021 | 4/1940 | Merrill | 239/53 X |
| 2,298,420 | 10/1942 | Salfisberg | 426/83 |
| 2,431,680 | 12/1947 | Barnett | 206/0.5 X |
| 4,026,131 | 5/1977 | Dugger et al. | 68/17 A |

FOREIGN PATENT DOCUMENTS

| | | | |
|---|---|---|---|
| 482426 | 3/1938 | United Kingdom | 426/77 |

*Primary Examiner*—Philip R. Coe
*Attorney, Agent, or Firm*—Philip Sands

[57] ABSTRACT

A laundry additive pouch is disclosed which includes a pair of plastic sheets joined to one another along mutually confronting and opposed marginal edges, one of the sheets including a smaller region remote from the marginal edges which mutually confronts and opposes an identical such smaller region of the other of the sheets and is joined thereto, each of the sheets having an opening confronting and opposing one another and surrounded by the joined portions of the smaller regions, and a laundry additive substance confined in a substantially annular-like space in the pouch between the joined marginal edges of the sheets and the joined portions of the smaller regions of the sheets.

13 Claims, 4 Drawing Figures

LAUNDRY ADDITIVE POUCH

BACKGROUND OF THE INVENTION

There are many conventional laundry additives available commercially which are introduced to laundry preferably during a rinse cycle of an automatic clothes washing machine, either because of the incompatability of the laundry additive with washing agents generally present in the wash cycle, or because of the increased efficiency of introducing the laundry additive during the rinse cycle as opposed to the wash or spin cycle of an automatic washing machine. With the ever-growing numbers and types of laundry additives available for use in washing clothes, a need has arisen for an effective device to most effectively automatically dispense the laundry additives at the proper interval of a rinse cycle of an automatic clothes washing machine. Indeed, a need has also arisen to provide such a device that will dispense the laundry additive in a clean, effective and simple manner, thereby obviating the difficulties commonly associated with the conventional, more complicated devices that are presently available.

One such type of laundry additive dispenser or pouch for automatically introducing a laundry additive into rinse water in automatic clothes washers is disclosed in U.S. Pat. No. 4,026,131, dated May 31, 1977. The problem generally attributable to the dispenser or pouch disclosed in the aforementioned patent is that it is not quite as simple in construction as it might otherwise be, nor as commercially economical to produce on a large scale as it might otherwise be. It has a rupturable fold region which adds to its complexity and cost to produce. It is of the variety, however, which can be mounted upon the central upright post of the agitator in a washer, and is adapted to rupture at its prescribed folded region when subjected to the centrifugal force of a rinse cycle in the washer to release its contents. In short, its manner of function is something of the general principle upon which the present invention is grounded, absent, however, in one regard, the fold region.

SUMMARY OF THE INVENTION

In this respect, the present invention may be described as a disposable laundry additive dispenser or pouch comprising a pair of sheet means joined to one another along mutually confronting and opposing marginal edges, one of said sheet means including a smaller region remote from said marginal edges which mutually confronts and opposes an identical such smaller region of the other of said sheet means and is joined thereto, each of said sheet means having an opening confronting and opposing one another and surrounded by the joined portions of said smaller regions, and a laundry additive substance in, preferably, though not necessarily, a substantially annular-like space in said pouch between said joined marginal edges of said sheet means and said joined portions of said smaller regions of said sheet means. A band is insertable through the openings in the joined smaller regions for mounting the pouch in an operative condition on the central post of an agitator of an automatic clothes washer. During the spin cycle, the openings will enlarge, thereby rupturing the pouch in part and making possible subsequent release of the contents of the pouch into the following rinse cycle.

As such, it is an object of the present invention to provide a laundry additive dispenser or pouch that is disposable in nature and which will dispense its laundry additive contents in a simple and efficient manner during the rinse period of an automatic clothes washing machine.

Another object of the present invention is to provide a laundry additive dispenser or pouch that is responsive to centrifugal force for dispensing its laundry additive contents.

A further object of the invention is to provide a device that has a laundry additive sealed in it, thereby obviating any need for the direct handling of the additive by a user which may be irritating to the user's skin, eyes, mucous membranes, or other parts of the body.

An additional object of the invention is to provide a device that will dispense a laundry additive without limitation as to the physical form (powder or liquid) the additive takes.

Still another object of the invention is to provide a laundry additive dispensing device that can be easily retrieved and disposed of at the end of the entire laundry washing cycle.

BRIEF DESCRIPTION OF THE DRAWINGS

The above and additional objects and advantages of the present invention will become more apparent upon reference to the following drawings in which.

DETAILED DESCRIPTION OF THE INVENTION

Figure 2:
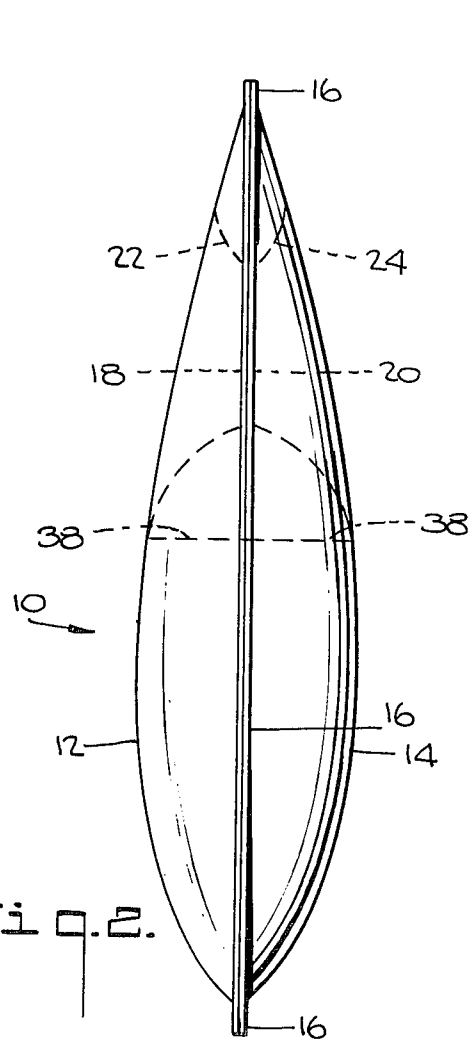
FIG. 2 is a side, elevational view, partly in phantom, illustrating the present invention.
Figure 1:
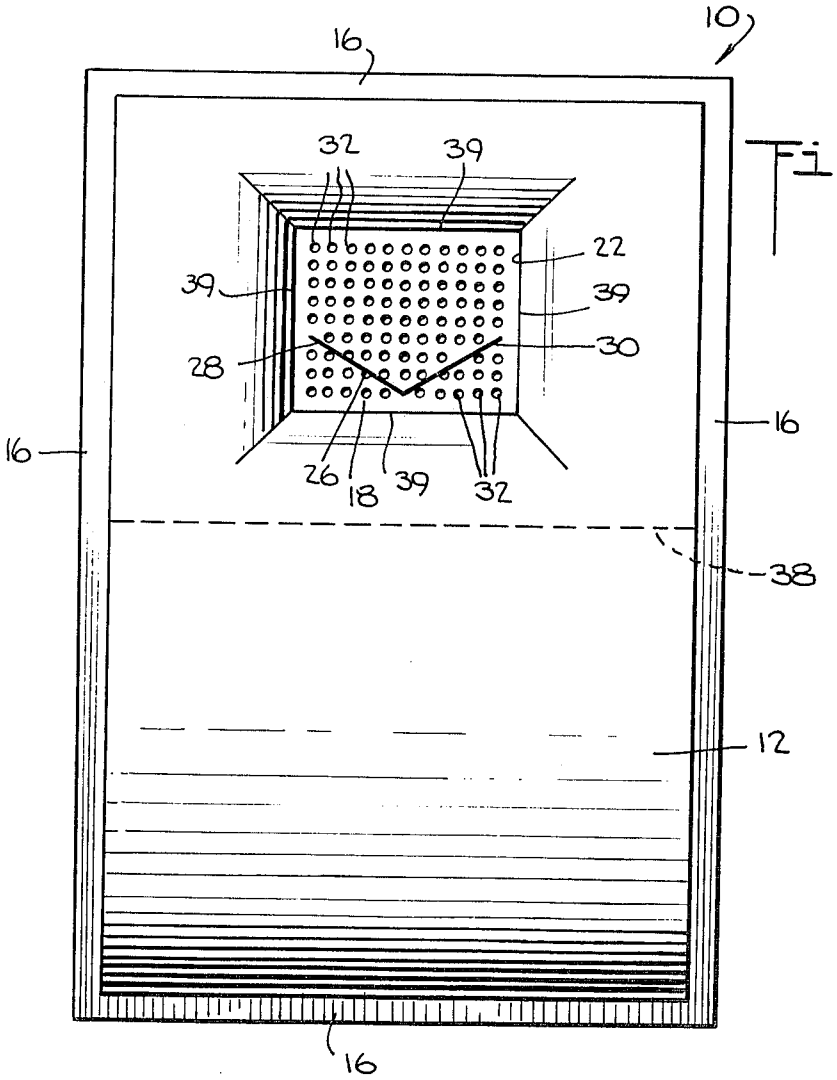
FIG. 1 is an elevational, front view, in schematic form, illustrating the present invention isolated from its environment of use.

Referring now to the drawings, and more particularly to FIGS. 1 and 2, the present invention involves a laundry additive dispenser or pouch identified generally by the reference character 10. The pouch 10 is fabricated from a pair of sheet means identified by the reference characters 12 and 14, respectively. The sheet means 12 and 14 are substantially identical size and configuration, for example, rectangular, and are joined, for example, by heat-sealing means of conventional nature to one another along their mutually confronting and opposed marginal edges 16.

Each of the sheet means 12 and 14 includes a smaller region identified, respectively, by the reference characters 18 and 20. These smaller regions are of substantially identical size and configuration, for example, rectangular, and are joined to one another over their entire extents, for example, by heat sealing means of conventional nature. The smaller regions 18 and 20 are preferably disposed in the upper one-third portion of the pouch, and create respective depressions or recesses 22 and 24 in the sheet means 12 and 14.

The smaller regions 18 and 20, joined as they are to one another, create an annular-like space internally of the pouch 10 in which is confined a laundry additive material, for example, a fabric softener. Preferably, the laundry additive material only partially fills the pouch 10 such that when the pouch 10 is held in a vertical condition, the laundry additive material remains below the location at which the joined smaller regions 18 and 20 are disposed.

Each of the joined smaller regions 18 and 20 is provided with a slit-like opening 26 of substantially identical size and configuration. Preferably, but not necessarily, the slit-like openings 26 are each formed with two sections 28 and 30 which merge with one another and form cooperatively an obtuse angle—namely, an angle in excess of ninety degrees. Furthermore, each of the joined smaller regions 18 and 20 may include tiny perforations 32 which surround the slit-like openings 26.

But for the slit-like openings 26 and the apertures 32, the remainder of the sheet means 12 and 14 is liquid-impervious and, therefore, will retain the contents of the pouch 10 without loss thereof until the pouch 10 is put into use. In this respect, since the joined smaller regions 18 and 20 are heat sealed to one another, notwithstanding the presence of the perforations 32 and the slit-like openings 26 within the sealed smaller regions 18 and 20, the pouch 10 remains fully sealed until it is put into use.

Preferably, though not necessarily, each of the sheet means 12 and 14 is comprised of a plastic laminate, each derived from plurality of superposed plastic layers bonded to one another in a conventional manner. Each sheet means 12 and 14, for example, may be comprised of a layer of nylon, a layer of polyethylene and a layer of plastic material identified by the trademark SURLYN manufactured by Wraps, Inc., of East Orange, N.J.

Figure 3:
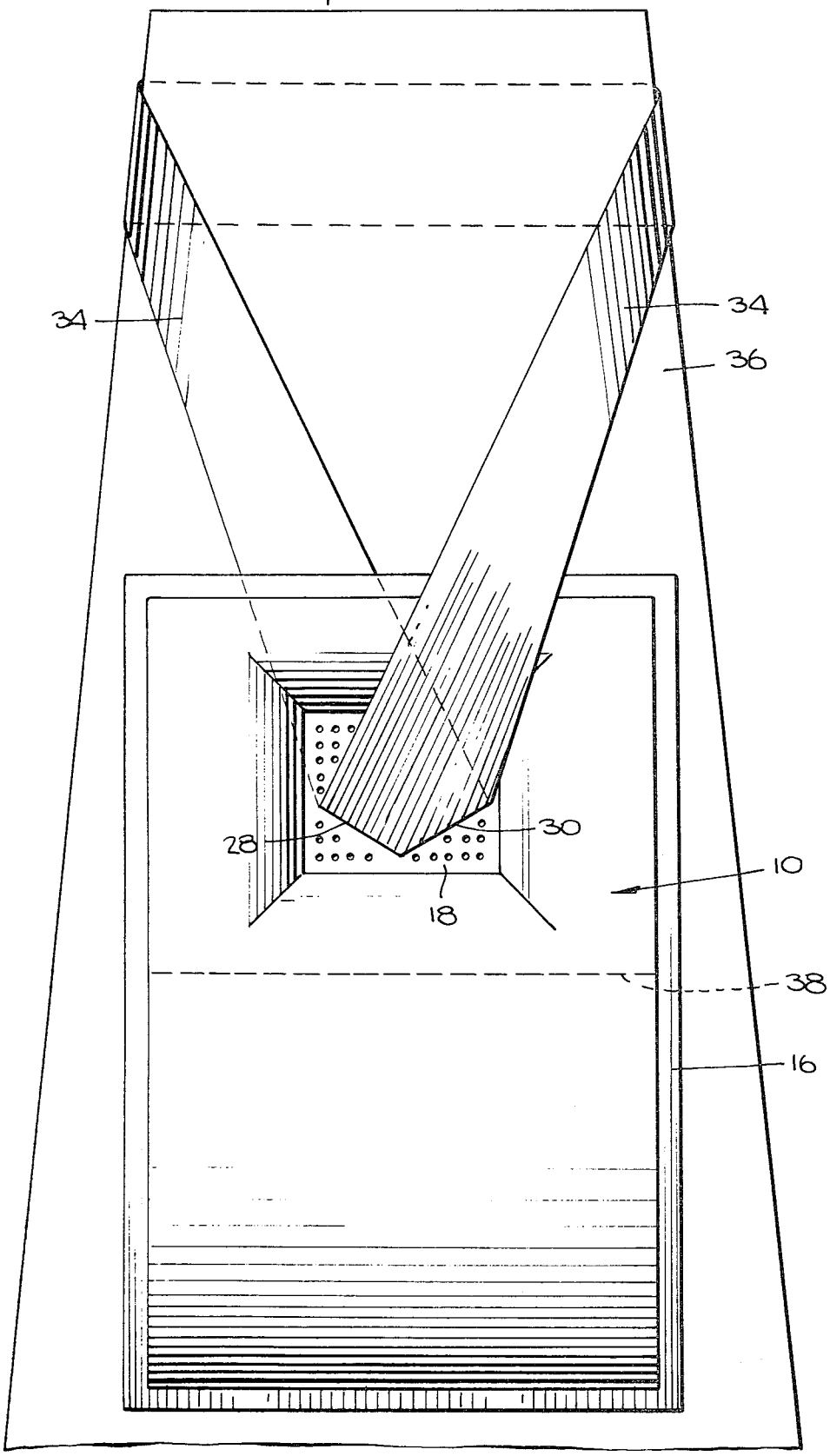
FIG. 3 is a fragmentary, side, elevational view, in schematic form, illustrating one means for securing the present invention to the central post of a washer agitator.

Referring now to FIG. 3, the pouch 10 includes an endless flexible band 34 which extends through the slit-like openings 26 in each of the joined smaller regions 18 and 20. The band 34 is of such an extent that it can be disposed in loosely surrounding relation upon a post 36 of an agitator (not shown) of an automatic clothes washing machine (also not shown). With the band 34 surrounding the post 36, the pouch 10 will hang in a substantially vertical attitude such that its contents remain below the smaller joined regions 18 and 20. The contents are illustrated in FIG. 3 and identified by the reference character 38.

However, during the spin cycle of the automatic clothes washing machine, as the clothes are spun rapidly around the post 36, the centrifugal force to which the clothes (not shown) and the pouch are subjected causes the pouch to be moved out of its illustrated vertical attitude and assume a substantially horizontal attitude. The amount of centrifugal force on the pouch 10 is a function, in part, of the weight of the laundry additive contents 38. Preferably, the contents 38 weigh in a range of approximately fifty to one hundred and fifty grams.

With the weight of the pouch being as it is, and the pouch subjected to the centrifugal force established during the spin cycle of the automatic clothes washing machine, the slit-like openings through which the endless band 34 projects begin to rupture and tear beyond the confines of the joined smaller regions 18 and 20. For example, the smaller regions 18 and 20 which are, for example, of rectangular configuration, include rectangular sides 39 (FIG. 1). As the slit-like openings 26 rupture, they do so beyond the sides 39 and into the annular-like region of the sheet means 12 and 14. Such tearing of the sheet means 12 and 14 permits subsequent gradual emptying of the laundry additive contents 38 of the pouch 10 into the wash during the rinse cycle following the spin. The contents are held below the rupture portion by centrifugal force until completion of the spin cycle.

To assist rupturing of the slit-like openings 26 in the joined smaller regions 18 and 20, for example, there may be present the aforementioned perforations 32. These perforations, as may be well appreciated, to a prescribed extent, weaken the joined smaller regions 18 and 20 to enhance rupturing of these regions into the surrounding portions of the sheet means 12 and 14. The need for the perforations 32 will depend, in large measure, upon the resultant thickness of the sheet means 12 and 14, as well as on the contemplated centrifugal force which the automatic clothes washing machine can generate during the spin cycle.

Figure 4:
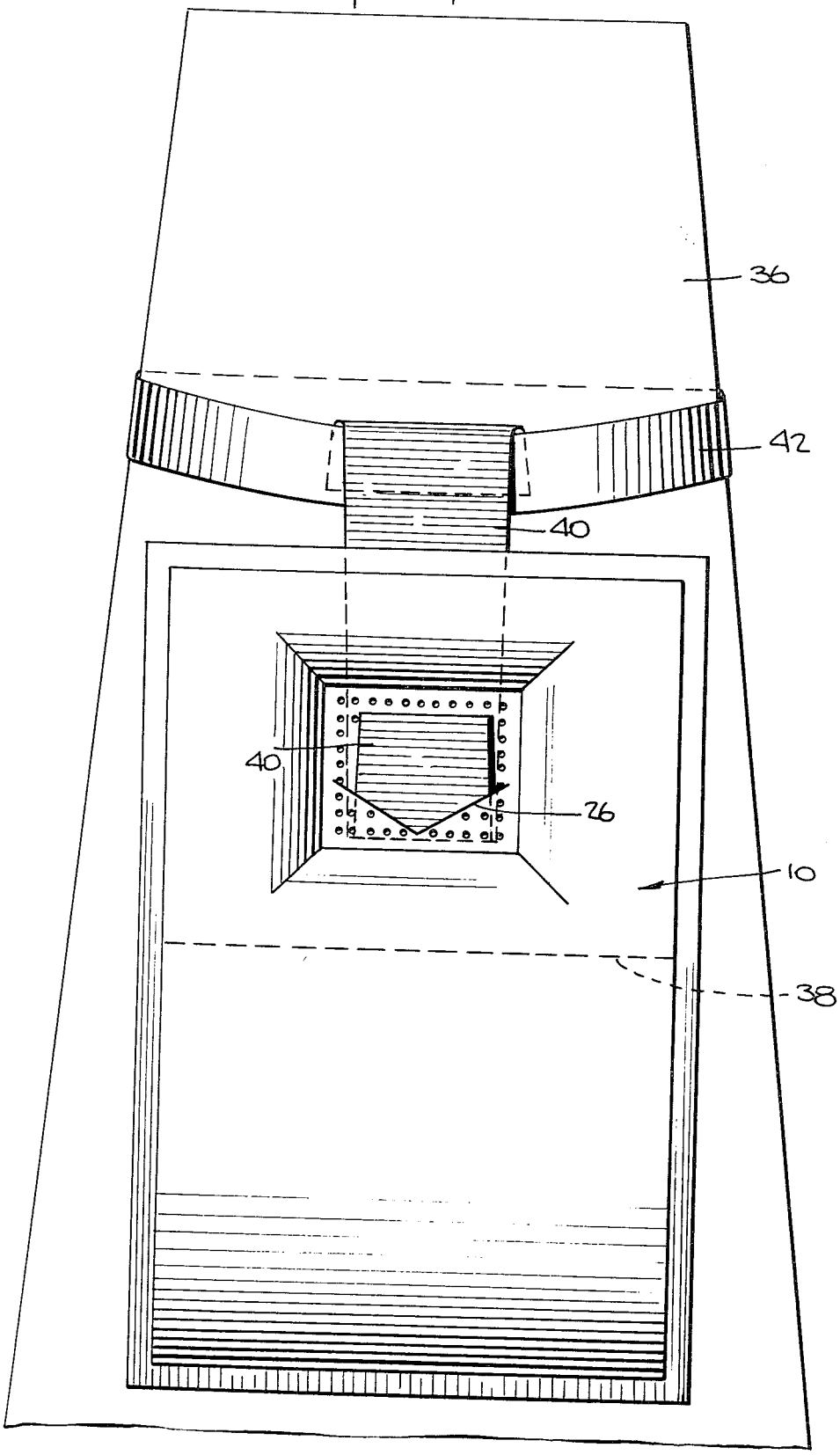
FIG. 4 is a view similar to FIG. 3, illustrating still an alternate means for securing the present invention to the central post of a washer agitator.

An alternate embodiment is illustrated in FIG. 4. This embodiment omits use of the endless band 34, and uses in its stead an upturned hook member 40 secured to a ring 42. The ring 42 can be manually disposed upon the upper portion of the post 36 of the washing machine agitator (not shown), and the pouch 10 can be mounted upon the hook 40 simply by inserting the hook 40 through the slit-like openings 26. Operative use of the pouch 10 via the alternate embodiment corresponds to that described above for the embodiment illustrated in FIG. 3.

Having thus set forth the nature of the present invention, it will be understood that other embodiments and variations thereof are contemplated, and all such other embodiments and variations of the present invention are deemed part of the present invention if encompassed by the appended claims.

What is claimed is:

1. A laundry additive pouch comprising a pair of sheets joined to one another along mutually confronting and opposed marginal edges, one of said sheets including a region remote from said marginal edges which mutually confronts and opposes an identical such region of the other of said sheets and is joined thereto, each of said sheets having an opening confronting and opposing one another and surrounded by the joined portions of said regions, and a laundry additive substance confined in said pouch between said joined marginal edges of said sheets and said joined portions of said regions of said sheets.

2. A pouch as claimed in claim 1, wherein each of said sheets are liquid impervious.

3. A pouch as claimed in claim 2, wherein said sheets are heat-sealed to one another at said marginal edges and regions.

4. A pouch as claimed in claim 3, wherein said sheets are each comprised of flexible plastic.

5. A pouch as claimed in claim 4, wherein each of said sheets is a plastic laminate comprised of a plurality of superposed layers bonded to one another.

6. A pouch as claimed in claim 5, wherein one of said layers is nylon, another of said layers is polyethylene, and another of said layers is a substance identified by the trademark SURLYN.

7. A pouch as claimed in claim 3, wherein said heat-sealed joined regions of said sheets are capable of being ruptured when subjected to a pulling force corresponding to the centrifugal force of a spin cycle in a washing machine.

8. A pouch as claimed in claim 7, including an endless band extending loosely through said mutually confronting and opposing openings in said sheets, said endless band having an extent sufficient to loosely surround an upright agitator in a washing machine.

9. A pouch as claimed in claim 8, wherein said additive substance in said pouch weighs approximately 50 to 150 grams.

10. A pouch as claimed in claim 1, wherein said additive substance is confined in said pouch in a space which is substantially annular-like between said joined marginal edges of said sheets and said joined portions of said regions of said sheets.

11. A pouch as claimed in claim 1, wherein said openings are each slit-like.

12. A pouch as claimed in claim 11, wherein said slit-like openings are constituted by two inclined portions forming an obtuse angle with one another.

13. A pouch as claimed in claim 1, wherein said openings are each surrounded by a plurality of perforations.

* * * * *